US008720612B2

(12) United States Patent
Corbett et al.

(10) Patent No.: US 8,720,612 B2
(45) Date of Patent: May 13, 2014

(54) CUTTING ELEMENT AND A METHOD OF MANUFACTURING A CUTTING ELEMENT

(75) Inventors: Loel G Corbett, Saratoga Springs, UT (US); Daniel J Belnap, Pleasant Grove, UT (US)

(73) Assignee: Smith International, Inc., Houston, TX (US)

( * ) Notice: Subject to any disclaimer, the term of this patent is extended or adjusted under 35 U.S.C. 154(b) by 610 days.

(21) Appl. No.: 12/623,569

(22) Filed: Nov. 23, 2009

(65) Prior Publication Data

US 2010/0126779 A1 May 27, 2010

Related U.S. Application Data

(60) Provisional application No. 61/117,456, filed on Nov. 24, 2008.

(51) Int. Cl.
*E21B 10/36* (2006.01)
*E21C 25/04* (2006.01)

(52) U.S. Cl.
USPC ..... 175/426; 175/328; 175/433

(58) Field of Classification Search
USPC ..... 175/426, 428, 432, 433, 328; 427/127
See application file for complete search history.

(56) References Cited

U.S. PATENT DOCUMENTS

| | | | | |
|---|---|---|---|---|
| 4,224,380 A | | 9/1980 | Bovenkerk et al. | |
| 4,811,801 A | | 3/1989 | Salesky | |
| 4,984,940 A | * | 1/1991 | Bryant et al. | 407/119 |
| 5,045,092 A | | 9/1991 | Keshavan | |
| 5,158,148 A | * | 10/1992 | Keshavan | 175/426 |
| 5,188,489 A | * | 2/1993 | Santhanam et al. | 407/119 |
| 5,232,318 A | * | 8/1993 | Santhanam et al. | 407/119 |
| 5,335,738 A | | 8/1994 | Waldenstrom et al. | |
| 5,338,506 A | | 8/1994 | Friederichs et al. | |
| 5,541,006 A | * | 7/1996 | Conley | 428/552 |
| 5,585,176 A | * | 12/1996 | Grab et al. | 428/336 |
| 5,697,046 A | * | 12/1997 | Conley | 428/547 |
| 5,716,170 A | * | 2/1998 | Kammermeier et al. | 408/145 |
| 5,750,247 A | * | 5/1998 | Bryant et al. | 428/323 |
| 5,792,403 A | | 8/1998 | Massa et al. | |
| 5,992,546 A | | 11/1999 | Heinrich et al. | |
| 6,011,248 A | | 1/2000 | Dennis | |
| 6,117,533 A | * | 9/2000 | Inspektor | 428/216 |

(Continued)

OTHER PUBLICATIONS

GB Search Report dated Dec. 18, 2009 for corresponding application No. GB0920024.7 filed Nov. 17, 2009.

(Continued)

*Primary Examiner* — Daniel P Stephenson
*Assistant Examiner* — Michael Wills, III

(57) ABSTRACT

The present disclosure relates in one aspect to a cutting element comprising a substrate and a cutting layer disposed on a surface of the substrate. The cutting layer comprises an ultra hard material. The substrate comprises tungsten carbide and a metal binder. The substrate has a magnetic saturation value in the range of from 80% to less than 85%. In another aspect, the magnetic saturation value may increase within the substrate along a gradient, wherein proximal to the interface with the cutting layer, the substrate has a magnetic saturation value in the range of from 80% to less than 85%. Also included are drill bits incorporating such cutting elements. Additionally, the present disclosure relates to methods of manufacturing cutting elements.

27 Claims, 5 Drawing Sheets

(56) References Cited

U.S. PATENT DOCUMENTS

| | | | | |
|---|---|---|---|---|
| 6,173,798 | B1 | 1/2001 | Bryant et al. | |
| 6,368,377 | B1 * | 4/2002 | Bryant et al. | 75/240 |
| 6,666,288 | B2 | 12/2003 | Kruse et al. | |
| 7,942,219 | B2 | 5/2011 | Keshavan et al. | |
| 2004/0141865 | A1 | 7/2004 | Keshavan et al. | |
| 2006/0159582 | A1 * | 7/2006 | Yu et al. | 419/6 |
| 2007/0023206 | A1 * | 2/2007 | Keshavan et al. | 175/374 |
| 2008/0023231 | A1 * | 1/2008 | Vail | 175/434 |
| 2008/0254213 | A1 * | 10/2008 | Yu et al. | 427/190 |
| 2010/0084196 | A1 * | 4/2010 | Bertagnolli et al. | 175/428 |
| 2011/0168454 | A1 * | 7/2011 | Keshavan et al. | 175/428 |
| 2011/0286877 | A1 * | 11/2011 | Gries | 419/18 |

OTHER PUBLICATIONS

Moyle, D.R., Kimmel, E.R., Utilization of magnetic saturation measurements for carbon control in cemented carbides; Metals/Materials Technology Series, 1984 ASM/SCTE Conference on Technology Advancements in Cemented Carbide Production, Dec. 2-4, 1984; pp. 1-5.

Webpage—www.carbidetechnologies.com/questions.php dated Oct. 31, 2008, Carbide Technologies, Inc., pp. 1-7.

Webpage—www.federalcarbide.com/cemented_tungsten_carbide.html dated Oct. 31, 2008, Federal Carbide Company, 2 pages.

Webpage—www.federalcarbide.com/tungsten_carbide.html dated Oct. 31, 2008, Federal Carbide Company, 2 pages.

* cited by examiner

| SUBSTRATE / CUTTING ELEMENT | GROUP A | GROUP B | GROUP C |
|---|---|---|---|
| MEDIAN MAGNETIC SATURATION VALUE (%) | 81.7 | 88.6 | 94.3 |
| RANGE OF MAGNETIC SATURATION VALUES (%) | 80.0-83.4 | 85.7-91.4 | 91.4-97.1 |
| FLEXURAL STRENGTH MEAN VALUE (MPa) | 1895 | 1554 | 1402 |
| RANGE OF FLEXURAL STRENGTH VALUES (MPa) (N=24) | 471 | 973 | 1037 |
| MGL WEAR RESISTANCE MEAN VALUE (RATIO) | 13.9 | 12.1 | 12.0 |
| RANGE OF MGL WEAR RESISTANCE VALUES (RATIO) (n=8) | 5.0 | 6.2 | 5.2 |
| MILLING IMPACT WEAR RESISTANCE MEAN MILL SCORE VALUE (INCH) [mm] | 53.0 [1346.2] | 51.3 [1303.0] | 52.5 [1333.5] |
| RANGE OF MILLING IMPACT WEAR RESISTANCE MILL SCORE VALUES (INCH) [mm] (n=4) | 11.0 [279.4] | 12.0 [304.8] | 13.0 [279.4] |
| IMPACT RESISTANCE 10 J IMPACT | 0/4 FAIL | 0/4 FAIL | 0/4 FAIL |
| IMPACT RESISTANCE 20 J IMPACT | 3/4 FAIL | 3/4 FAIL | 3/4 FAIL |

*FIG. 7*

CUTTING ELEMENT AND A METHOD OF MANUFACTURING A CUTTING ELEMENT

CROSS-REFERENCE TO RELATED APPLICATIONS

This application claims the priority of U.S. provisional patent application Ser. No. 61/117,456, filed Nov. 24, 2008, which is hereby incorporated by reference in its entirety.

FIELD OF THE INVENTION

The present disclosure is generally related to cutting elements containing metal carbide substrates with specified magnetic saturation values and a method of manufacturing such cutting elements. The present disclosure is also generally related to a method for manufacturing cutting elements containing metal carbide substrates which method selects the substrates such that the variability in magnetic saturation values are minimized from batch to batch.

BACKGROUND OF THE INVENTION

Cutting elements containing a cutting layer of ultra hard materials are known in the art. Such cutting elements can be used in a number of different applications, such as tools for mining, cutting, machining and construction applications. Suitably, such cutting elements can be used in drill bits such as roller cone drill bits, percussion or hammer bits, diamond impregnation bits, and shear cutter bits.

Rotary drill bits with no moving elements are typically referred to as "drag" bits. Drag bits are often used to drill a variety of rock formations. Drag bits include those having cutting elements (sometimes referred to as cutters, cutter elements, or inserts) attached to the bit body. Cutting elements, such as shear cutters for rock bits, typically have a substrate (or body) with a cutting layer (sometimes referred to as a "cutting table" or "table") deposited onto or otherwise bonded to the substrate at an interface surface. The substrate is generally made from cemented or sintered metal carbide, typically tungsten carbide, while the cutting layer is made from an ultra hard material such as polycrystalline diamond (PCD) or polycrystalline cubic boron nitride (PCBN).

An example of a typical drag bit having a plurality of cutting elements with ultra hard working surfaces is shown in FIG. 1. The drill bit 10 includes a bit body 12 and a plurality of blades 14 that are formed on the bit body 12. The blades 14 are separated by channels or gaps 16 that enable drilling fluid to flow between to both clean and cool the blades 14 and the cutting elements 18. Cutting elements 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylinder cutting element 18. Thus, the working surface 20 and the side surface 21 meet or intersect to form a circumferential cutting edge 22.

Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14, and the cutting elements 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side (gage) surface 32. The drill bit 10 also has a heel surface 45 located adjacent the outer side surface 32. The gage surface 32 and heel surface 45 may include cutting elements positioned therein to help maintain the gage of the well bore or to back ream the formation as the drill bit is removed from the well bore. The particular materials used to form drill bit bodies are selected to provide adequate toughness, while providing good resistance to abrasive and erosive wear. For example, in the case where an ultra hard cutting element is to be used, the bit body 12 may be made from powdered tungsten carbide infiltrated with a binder alloy within a suitable mold form. In one manufacturing process, the crown 26 includes a plurality of holes or pockets 34 that are sized and shaped to receive a corresponding plurality of cutting elements 18.

The combined plurality of surfaces 20 of the cutting elements 18 effectively forms the cutting face of the drill bit 10. Once the crown 26 is formed, the cutting elements 18 are positioned in the pockets 34 and affixed by any suitable method, such as by brazing, adhesion, mechanical means such as interference fit or the like. The design depicted provides the pockets 34 inclined with respect to the surface of the crown 26. The pockets 34 are inclined such that the cutting elements 18 are oriented with the working surface 20 at a desired rake angle in the direction of rotation of the bit 10, so as to enhance cutting. It should be understood that in an alternative construction (not shown), the cutting elements may each be substantially perpendicular to the surface of the crown, while an ultra hard surface is affixed to a substrate at an angle so that a desired rake angle is achieved at the working surface.

A cutting element 18 is shown in FIG. 2. A shear cutter cutting element 18 has a cylindrical cemented carbide substrate body 38 having an end face or upper surface 54. A cutting layer 44 of an ultra hard material, such as polycrystalline diamond (PCD) or polycrystalline cubic boron nitride (PCBN), forms the working surface 20 and the cutting edge 22. A bottom surface 52, referred to herein as the "interface surface", of the cutting layer 44 is bonded onto the surface of the substrate 38. The top exposed surface or working surface 20 of the cutting layer 44 is opposite the bottom interface surface 52. The cutting layer 44 typically has a flat or planar working surface 20, but may also have a curved exposed surface, that meets the side surface 21 at a cutting edge 22.

One type of ultra hard working surface 20 for drag bits is formed from polycrystalline diamond, typically known as a polycrystalline diamond compact (PDC), PDC cutters, PDC cutting elements, or PDC inserts. Drill bits made using polycrystalline diamond compact (PDC) cutting elements are known generally as PDC bits.

FIG. 3 illustrates a cutting element in the form of an insert 76, such as a diamond enhanced insert (DEI), used in wear or cutting applications in a roller cone drill bit or percussion or hammer drill bit. Such inserts 76 can be formed from blanks comprising a substrate portion 78 formed from one or more substrate materials 80 and a cutting layer 82 having a working surface 84 formed from an ultra hard material. FIG. 4 illustrates a cutting element in the form of an insert (button or stud) with a cutting layer in the form of a cutting table used in wear or cutting applications. Such cutting elements 102 can also be formed from blanks comprising a substrate portion 104 formed from one or more substrate materials 106 and a cutting layer 108 having a working surface 110 formed from an ultra hard material. The cutting layer of such cutting elements may have chamfered edges 112.

Rotary drill bits with moving elements also utilize cutting elements containing a cutting layer of ultra hard materials. FIG. 5 illustrates a roller cone drill bit in the form of a rock bit 86 comprising a number of wear or cutting inserts 76, as discussed above and illustrated in FIG. 3. The rock bit 86 comprises a bit body having three legs 90 and a roller cutter cone 92 mounted on a lower end of each leg. The inserts 76 are provided on the surfaces of each cutter cone 92 for bearing on a rock formation being drilled. The roller cone drill bit may also contain inserts 102 (not shown), as discussed above and illustrated in FIG. 4, in areas subject to wear such as the bit leg.

FIG. 6 illustrates the inserts 76 described above as used with a percussion or hammer bit 94. The hammer bit comprises a hollow steel bit body 96 having a threaded pin 98 on an end of the body for assembling the bit onto a drill string (not shown) for drilling oil wells and the like. A plurality of the inserts 76, as discussed above and illustrated in FIG. 3, are provided on the surface of a head 100 of the body 96 for bearing on the rock formation being drilled. The percussion or hammer bit may also contain inserts 102 (not shown), as discussed above and illustrated in FIG. 4, in areas subject to wear.

The ultra hard working surface, in the form of a layer (sometimes referred to as a "table") is bonded to the substrate at an interface. The substrate may be cemented metal carbide which may, for example, be formed by sintering a mixture of stoichiometric tungsten carbide and a metal binder.

The cutting element is typically formed by placing the cemented metal carbide substrate into a container for use in a press. A mixture of diamond grains or diamond grains and catalyst material may be placed atop the substrate and treated under high pressure, high temperature conditions. In doing so, the metal binder (often cobalt) migrates from the substrate and passes through the diamond grains to promote intergrowth between the diamond grains. As a result of the migration of the metal binder, the diamond grains become bonded to each other to form the diamond layer, and the diamond layer is also bonded to the substrate.

During the manufacture of the cutting elements, there is a desire to improve infiltration of the metal binder into the ultra hard material layer at the interface to promote improved bonding of the ultra hard material layer to the substrate. Further, there is a desire to improve the flexural strength of the substrate used to manufacture the cutting element to improve the resistance to substrate fracture during the joining process of the cutting element to the drill bit and during the operation of the drill bit.

SUMMARY OF THE INVENTION

In one aspect, embodiments of the present disclosure relate to a cutting element comprising a substrate and a cutting layer disposed on a surface of the substrate. The cutting layer comprises an ultra hard material. The substrate comprises tungsten carbide and a metal binder. The substrate has a magnetic saturation value in the range of from 80% to less than 85%.

In another aspect, embodiments disclosed herein relate to a cutting element comprising a substrate and a cutting layer disposed on a surface of the substrate. The cutting layer comprises an ultra hard material. The substrate comprises tungsten carbide and a metal binder. The magnetic saturation value increases within the substrate along a gradient in the direction away from the interface of the substrate and the cutting layer. Further, within the substrate proximal to the interface, the magnetic saturation value is in the range of from 80% to less than 85%.

In another aspect, embodiments disclosed herein relate to a method of manufacturing a cutting element comprising selecting a substrate comprising tungsten carbide and a metal binder which substrate has a magnetic saturation value in the range of from 80% to less than 85%; and forming a cutting layer over a surface of the substrate which cutting layer comprises an ultra hard material.

In yet another aspect, embodiments disclosed herein relate to a drill bit comprising a bit body and a plurality of cutting elements affixed to said bit body, wherein at least one of said plurality of cutting elements comprises a substrate and a cutting layer disposed on a surface of the substrate. The cutting layer comprises an ultra hard material. The substrate comprises tungsten carbide and a metal binder. The substrate has a magnetic saturation value in the range of from 80% to less than 85%.

In yet another aspect, embodiments disclosed herein relate to a method of manufacturing cutting elements comprising selecting a first batch of substrates containing tungsten carbide and a metal binder, wherein the substrates have magnetic saturation values that vary by at most 5%; selecting a second batch of substrates containing tungsten carbide and a metal binder, wherein the substrates have magnetic saturation values which vary by at most 5%, and wherein the magnetic saturation values of the first batch of substrates and the second batch of substrates vary by at most 5%; and forming a cutting layer comprising an ultra hard material on a surface of the first and second batches of substrates.

Other aspects and advantages of the disclosure will be apparent from the following description and the appended claims.

BRIEF DESCRIPTION OF THE DRAWINGS

FIG. 7 is a table containing test data for various tungsten carbide substrates and PCD shear cutter cutting elements.

DETAILED DESCRIPTION OF THE INVENTION

In one aspect, embodiments disclosed herein relate to improved cutting elements for use in a drill bit. In particular, one or more embodiments disclosed herein relate to cutting elements for use in a drill bit and methods of manufacturing such cutting elements using substrates having a magnetic saturation value in the range of from 80% to less than 85%. Such cutting elements exhibit one or more improved properties such as flexural strength and wear resistance, while maintaining impact resistance and thermal stability.

In another aspect, embodiments disclosed herein relate to an improved method of manufacturing cutting elements for use in a drill bit. In particular, such method includes selecting substrates with a small variation in magnetic saturation values within a batch and from batch-to-batch. Reducing the variation in magnetic saturation values of the substrates used to manufacture cutting elements results in being able to improve one or more desired properties of the substrate and/or the cutting element.

Figure 1:
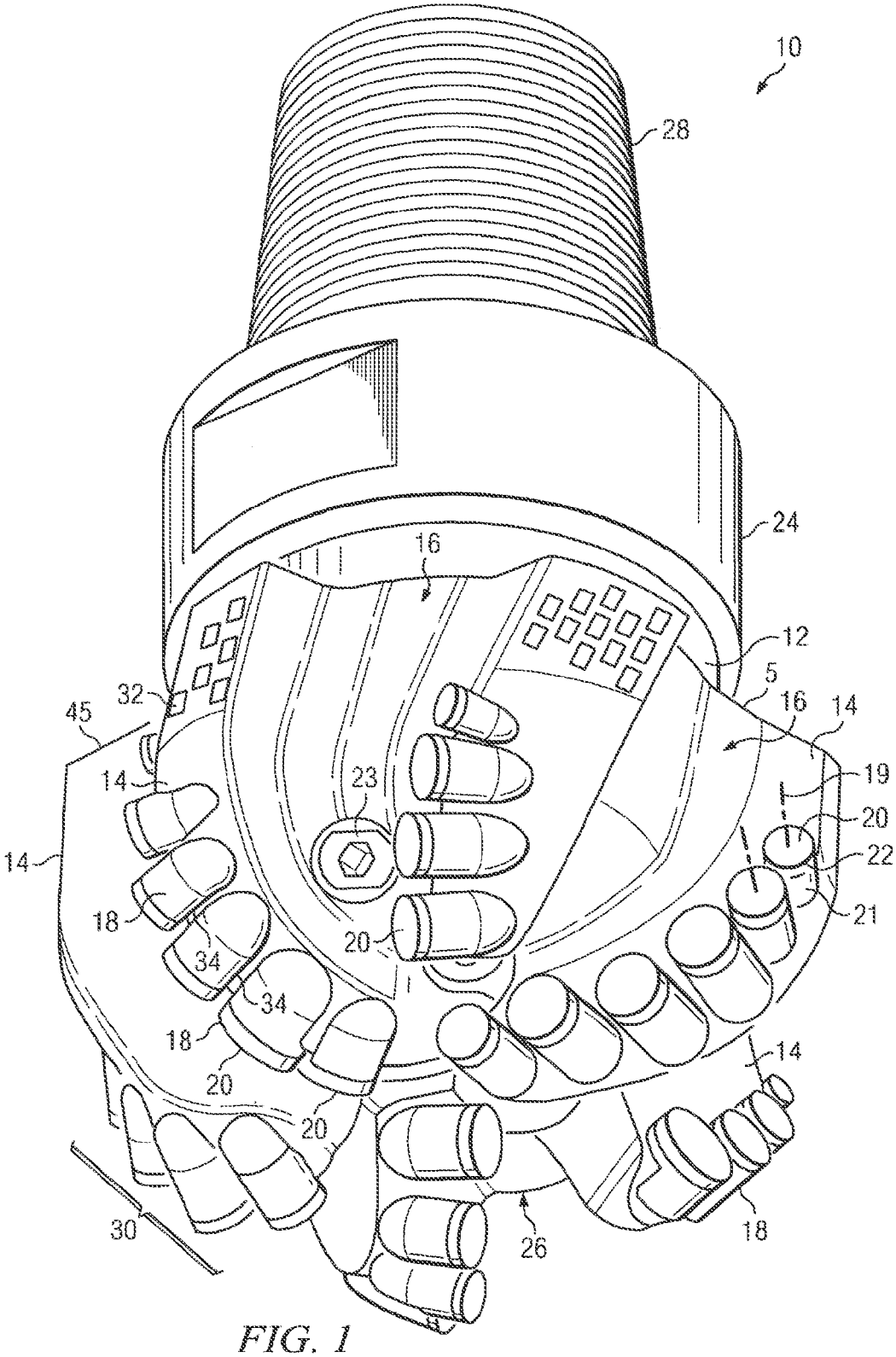
FIG. 1 is a perspective view of a drag bit.
Figure 2:
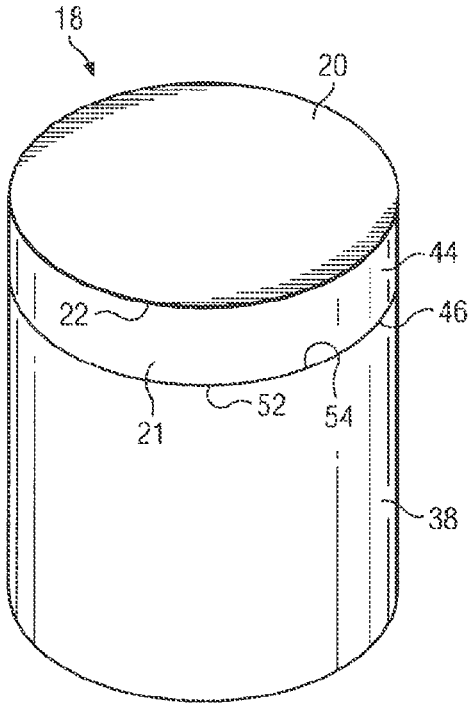
FIG. 2 is a perspective view of a shear cutter cutting element.
Figure 3:
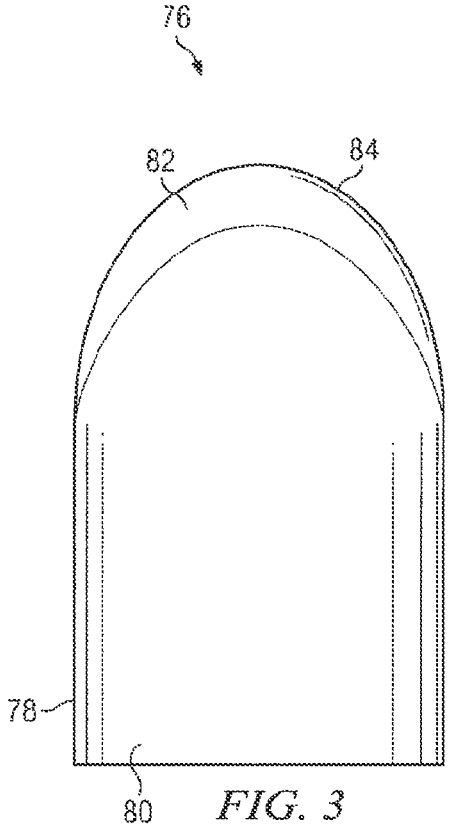
FIG. 3 is a side view of an insert cutting element.
Figure 4:
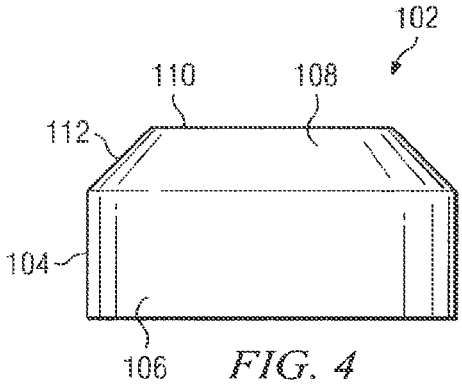
FIG. 4 is a side view of an insert cutting element.
Figure 5:
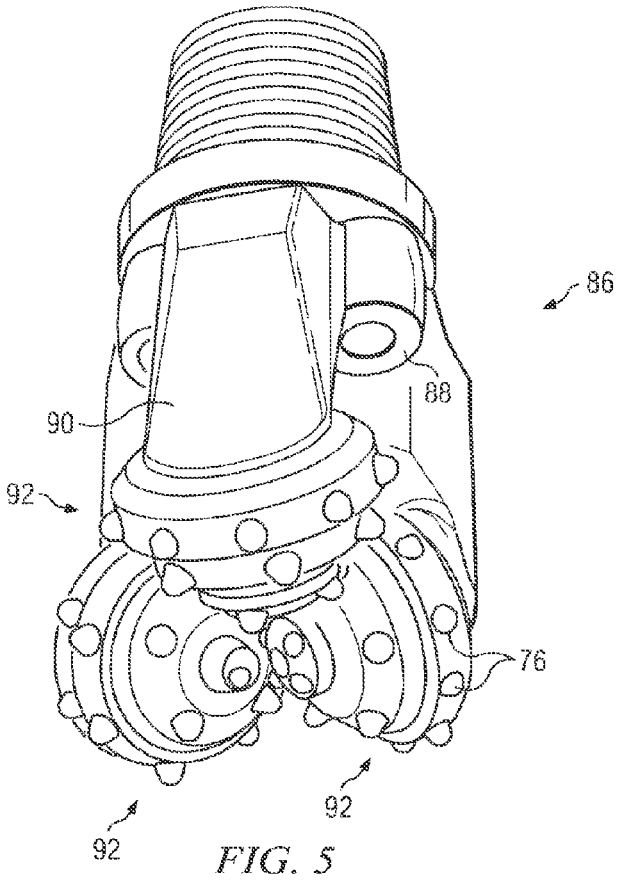
FIG. 5 is a perspective view of a rotary roller cone bit.
Figure 6:
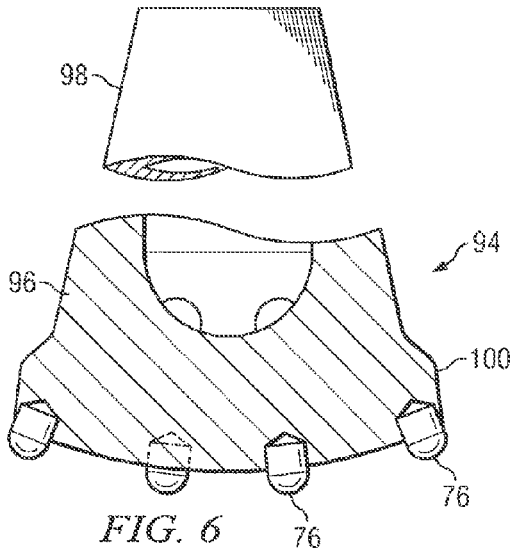
FIG. 6 is a perspective view of a percussion or hammer bit.

The cutting element of the present disclosure comprises a substrate and a cutting layer disposed on at least a portion of the substrate. FIGS. 2-4, as discussed hereinbefore, depict cutting elements for use in a drill bit. Cutting elements of the present disclosure may be a shear cutter or an insert, suitably a shear cutter. It is to be understood that cutting elements of this disclosure can be used which have geometries other than that specifically described above and illustrated in FIGS. 2-4. The cutting layer comprises an ultra hard material. As used herein, the term "ultra hard material" is understood to refer to those materials known in the art to have a grain hardness of about 4000 HV or greater. Such ultra hard materials can include those capable of demonstrating physical stability at temperatures above about 750° C. Such ultra hard material in the formed cutting layer may be a polycrystalline ultra hard material suitably selected from polycrystalline diamond, polycrystalline cubic boron nitride, and combinations thereof, more suitably polycrystalline diamond.

The substrate is a cemented (or sintered) carbide which is a composite material comprising tungsten carbide and a metal binder. The substrate may be formed from sintering a mixture containing stoichiometric tungsten carbide material and a metal binder. As used herein, the term "stoichiometric tungsten carbide" is meant to include tungsten carbides having a carbon content in the range of from 6.08% to 6.18%, suitably about 6.13% by weight, based on the weight of tungsten carbide. There are various methods of manufacturing stoichiometric tungsten carbides (monotungsten carbide), for example a carburization process where solid-state diffusion of carbon into tungsten metal occurs to produce monotungsten carbide or a high temperature thermite process during which ore concentrate is converted directly to monotungsten carbide. The metal binder may be selected from Group VIII elements of the Periodic table. In particular, the metal binder may be selected from cobalt, nickel, iron, mixtures thereof, and alloys thereof. Preferably, the metal binder comprises cobalt.

The substrate may or may not contain a grain growth inhibitor. As used herein, the term "grain growth inhibitor" is understood to refer to those materials known in the art which inhibit the grain growth of tungsten carbide during the sintering process. Such grain growth inhibitors may include, but are not limited to, compounds of Group IVB, VB and VIB elements of the Periodic Table, in particular chromium and vanadium compounds such as vanadium carbide and chromium carbide. Suitably, the substrate may not contain a grain growth inhibitor.

In one or more embodiments, the substrate may contain tungsten carbide in the range of from 75 to 98% by weight, based on the total weight of the substrate, suitably from 80 to 95% by weight, more suitably from 85 to 90% by weight. The substrate may contain the metal binder in an amount in the range of from 2 to 25% by weight, based on the total weight of the substrate. In one or more embodiments the cutting element may be a shear cutter (e.g., as illustrated in FIG. 2) or an insert having a cutting table (e.g., as illustrated in FIG. 4), such a cutting element has a substrate which suitably contains the metal binder in an amount in the range of from 5 to 15% by weight, more suitably from 10 to 15% by weight, based on the total weight of the substrate. In one or more embodiments, the cutting element may be an insert as illustrated in FIG. 3. Such a cutting element has a substrate which suitably contains the metal binder in an amount in the range of from 2 to 12% by weight, more suitably from 4 to 8% by weight, based on the total weight of the substrate.

In one or more embodiments, the substrate may be prepared by combining tungsten carbide, such as a stoichiometric tungsten carbide powder, and a metal binder, such as cobalt. The metal binder may be provided in the form of a separate powder or as a coating on the tungsten carbide. Optionally, a carbonaceous wax and a liquid diluent, such as water or an organic solvent (e.g., an alcohol), may also be included in the mixture. The mixture may then be milled, granulated and pressed into a green compact. The green compact may then be de-waxed and sintered to form the substrate. De-waxing may be conducted under conditions sufficient to remove any diluents and wax material used to form the green compact. Sintering may be conducted under conditions sufficient to form the substrate and may use vacuum sintering, hot-isostatic pressing sintering, microwave sintering, spark plasma sintering, etc. During sintering, temperatures may be in the range of from 1000 to 1600° C., in particular from 1300 to 1550° C., more in particular from 1350 to 1500° C. The desired magnetic saturation values may be obtained by controlling the conditions during sintering such as time, temperature, pressure, carbon and oxygen content in the sintering environment, etc. Substrates of the present disclosure may be made by any state of the art process for sintering tungsten carbides capable of producing substrates with the desired magnetic saturation values, for example the process of Ceratizit Austria Gesellschaft m.b.H of Reutte, Austria. The sintered substrate may have a planar or non-planar surface. It is understood that the cutting elements of the present disclosure can be configured other than specifically disclosed or illustrated herein.

A cutting layer of ultra hard material may then be disposed over at least a portion of the surface of the substrate. A mixture comprising ultra hard material particles may be placed in contact with the surface of the substrate and subjected to a high pressure, high temperature (HPHT) pressing process sufficient to cause crystalline bonds to form between ultra hard material particles in the cutting layer and the ultra hard material to bond to the substrate at least in part due to the infiltration of the metal binder from the substrate into the cutting layer.

For example, a powder mixture of diamond grains (natural or synthetic) and optionally a catalyst material may be placed adjacent the substrate and sintered under HPHT conditions sufficient to form polycrystalline diamond in the cutting layer and to bond the polycrystalline diamond to the substrate. Alternatively, the diamond grains may be provided in the form of a green-state part comprising diamond grains and optionally catalyst material contained by a binding agent, e.g., in the form of diamond tape or other formable/conformable diamond product used to facilitate the manufacturing process. When such green-state parts are used to form the cutting element, it may be desirable to preheat before the HPHT consolidation and sintering process. The resulting cutting element contains a cutting layer with a material microstructure made of a substantially uniform phase of bonded together diamond crystals, with the binder from the substrate and/or catalyst material disposed within interstitial regions that exist between the bonded diamond crystals. The catalyst material may be selected from Group VIII elements of the Periodic table, in particular selected from cobalt, nickel, iron, mixtures thereof, and alloys thereof, preferably cobalt. The catalyst material may be the same composition as the metal binder or a different composition. When infiltration from the substrate is the primary source of metal in the interstitial regions of the cutting layer, the metal binder in the substrate has a dominant effect on the metal composition in the interstitial regions of the cutting layer.

The ultra hard material particles used to form the cutting layer may have an average diameter grain size in the range of from about 10 nanometers to about 100 micrometers, suitably in the range of from 1 to 50 micrometers. The ultra hard material particles may have a mono-modal or multi-modal grain size distribution. If a catalyst material is used, the catalyst material may be in the form of a separate powder or as a coating on the particles. When using the catalyst material in the powder form, the powder may have an average grain size in the range of from about 10 nanometers to about 50 micrometers. The catalyst material may be used in a quantity up to about 30% by weight based on the total weight of the cutting layer mixture. Where high wear resistance is desired in the cutting layer, catalyst material may be used in an amount of less than 5% by weight, based on the total weight of the cutting layer mixture. The catalyst material facilitates intercrystalline bonding of the ultra hard material particles (e.g., diamond grains) during the HPHT sintering process.

Alternatively, a previously partially sintered or fully sintered cutting layer of ultra hard material may be placed in contact with the surface of the substrate and subjected to conditions sufficient to bond the cutting layer to the substrate. The sintered cutting layer of ultra hard material may be a thermally stable polycrystalline (TSP) diamond layer formed by treating the diamond layer to partially or completely remove the metal binder or catalyst material from the cutting layer. During the HPHT bonding process, metal binder from the substrate infiltrates into the diamond layer attaching the diamond layer to the substrate. Treatment methods include chemical treatment such as by acid leaching or aqua regia bath; electrochemical treatment such as by electrolytic process; liquid metal treatment such as by infiltrating the cutting layer to replace the metal binder or catalyst material with another non-catalytic metal. Such treatment methods are described in US2008/0230280 A1 and U.S. Pat. No. 4,224,380, which methods are incorporated herein by reference.

In one or more embodiments, the cutting element may be formed by utilizing a partially densified substrate. As used herein, fully densified is understood to mean tungsten carbide particles infiltrated with a metal binder which have substantially zero or no porosity. Partially densified substrates are described in US 2004/0141865 A1, such description is incorporated herein by reference. A mixture comprising ultra hard material particles, as discussed above, may be placed in contact with the surface of the partially densified substrate and subjected to a high pressure, high temperature (HPHT) sintering process. Alternatively, a previously partially sintered or fully sintered layer of ultra hard material may be placed in contact with the surface of the partially densified substrate and subjected to conditions sufficient to bond the cutting layer to the substrate. The sintered cutting layer of ultra hard material may be a TSP diamond layer formed by treating the diamond layer, as discussed above, to partially or completely remove the metal binder or catalyst material from the cutting layer.

In one or more embodiments, the cutting element may be formed by utilizing pre-cemented tungsten carbide granules. The pre-cemented tungsten carbide granules and ultra hard material mixture, as discussed above, may be placed in contact and subjected to a HPHT sintering process. Alternatively, the pre-cemented tungsten carbide granules may be placed in contact with a previously partially sintered or fully sintered layer of ultra hard material and subjected to conditions sufficient to bond the cutting layer to the substrate. The sintered cutting layer of ultra hard material may be a TSP diamond layer formed by treating the diamond layer, as discussed above, to partially or completely remove the metal binder or catalyst material from the cutting layer.

In one or more embodiments, the cutting layer of the cutting element may be treated to partially or completely remove the metal binder or catalyst material therefrom. Such treatment methods include those described hereinbefore, preferably acid leaching.

In one or more embodiments, the cutting element may or may not contain one or more transition layers between the cutting layer and the substrate. Transition layers typically may be used for a variety of reasons such as accommodating any mismatch in mechanical properties that exist between the cutting layer and the substrate. Example materials suitable for forming the transition layers include those materials that can be broadly categorized as carbide forming materials, ceramic materials, non-carbide forming materials, and ultra hard materials. Carbide forming materials include refractory metals selected from Groups IV through VII of the Periodic table such as tungsten, molybdenum, zirconium and the like. Ceramic materials include TiC, $Al_2O_3$, $Si_3N_4$, SiC, SiAlON, TiN, $ZrO_2$, WC, $TiB_2$, AlN, $SiO_2$, and $Ti_xAlM_y$ (where x is between 2 to 3, M is carbon or nitrogen or a combination thereof, and y is between 1 and 2). Non-carbide forming materials include non-refractory metals and high-strength braze alloys that do not react with carbon and thus do not form a carbide. The transition layer may be provided in the form of a preformed layer (e.g., in the form of a foil or the like), in the form of a green-state part, or in the form of a coating (e.g., chemical vapor deposition or physical vapor deposition). The transition layer may contain 5% to 80% by weight of tungsten carbide, based on the total weight of the transition layer.

Numerous other variations are also well known in the art for forming cutting elements. The above descriptions are provided for illustrative purposes and are not intended to limit the present disclosure.

The sintered substrate is a cemented carbide which comprises two phases. A first phase comprises the tungsten carbide ("carbide phase") and the second phase comprises the metal binder ("binder phase"). The binder phase may be pure metal binder or a solid solution of metal binder and tungsten and/or carbon. During the sintering process, the metal binder forms a liquid phase which can allow tungsten and/or carbon to dissolve into the metal binder phase. Upon introduction of non-magnetic components, such as dissolved tungsten, into the metal binder phase, the magnetic saturation decreases. Magnetic saturation is the condition when, after a magnetic field strength becomes sufficiently large, further increase in the magnetic field strength produces no additional magnetization in a magnetic material. The magnetic saturation of the substrate is structure insensitive and is affected by the purity of the binder phase.

Magnetic saturation is measured by applying a magnetic field to an initially unmagnetized material, such as the substrate, and measuring the induced magnetic properties of the substrate. Table I below shows a hypothetical measured magnetic saturation value at 80% and 100% magnetic saturation for the binder phase using the whole substrate for measurement and the calculated magnetic saturation value of the hardmetal (or substrate) at 80% and 100% magnetic saturation. Hardmetal magnetic saturation values are determined by multiplying the measured magnetic saturation value for the binder phase by the weight percent of metal binder present in the substrate. Commercial equipment is available to perform such analysis, for example equipment sold by LE USA Incorporated, Walker LDJ Scientific, Lake Orion, Mich. Since the units used to report measured magnetic saturation values vary between various instruments, it is common in the art to express the magnetic saturation as a percent. A magnetic saturation value of 100% represents a binder phase consisting of only magnetic components such as the metal binder. Magnetic saturation values of less than 100% represent a binder phase having dissolved tungsten in the metal binder. The percent magnetic saturation is determined by taking the magnetic saturation value of interest and dividing by the magnetic saturation value representative of 100% magnetic saturation (i.e., a binder phase consisting only of metal binder). For example, the measured magnetic saturation value for the binder phase of Substrate A which contains cobalt and dissolved tungsten is 1650 $G \cdot cm^3/g$ and the magnetic saturation value for a similar substrate representing a magnetic saturation of 100% is 2020 $G \cdot cm^3/g$. Thus, the magnetic saturation value for Substrate A is $(1650\ G \cdot cm^3/g \div 2020\ G \cdot cm^3/g) \times 100 = 81.7\%$.

TABLE I

| Description | 80% magnetic saturation value* | 100% magnetic saturation value** | Units | Comments |
|---|---|---|---|---|
| Binder Phase Magnetic Saturation (4TTσ) | 1600 | 2020 | $G \cdot cm^3/g$ | Cobalt as the metal binder |
| Binder Phase Magnetic Moment (σ) | 127.3 | 160.7 | $G \cdot cm^3/g$ | Cobalt as the metal binder |
| Hardmetal Magnetic Saturation*** (4TTσ) | 208.0 | 262.6 | $G \cdot cm^3/g$ | Values will change with cobalt concentration |
| Hardmetal Magnetic Moment*** (σ) | 16.5 | 20.9 | $G \cdot cm^3/g$ | Values will change with cobalt concentration |

*80% saturation value is the approximate eta phase limit below which a significant amount of eta phase is observed.
**100% saturation value which is used as the denominator to determine magnetic saturation percentage.
***Values represent a 13% by weight cobalt content in the substrate.

In certain embodiments of the present disclosure, the substrate has a magnetic saturation value in the range of from 80% to less than 85%, for example 80.5%, 81%, 81.5%, 82%, 82.5%, 83%, 83.5%, 84%, or 84.5%. Suitably, the substrate has a magnetic saturation value in the range of from 80.5% to 84.5%; more suitably from 81% to 84%. These magnetic saturation values are as measured on the sintered substrate, as discussed above, and not within the substrate, as discussed below. Without wishing to be bound by theory, it is believed that a substrate having a magnetic saturation value within these ranges exhibits less variation in the melting point within the binder phase which reduces the instances of too rapid infiltration of the binder into the cutting layer during sintering which can result in reduced interface defects in the cutting element. Further, substrates having a magnetic saturation value within these ranges can exhibit improved flexural strength and cutting elements made from such substrates can exhibit improved wear resistance compared to substrates having magnetic saturation values outside of these ranges.

The magnetic saturation values of the substrates can be achieved by various methods known in the art such as by adjusting the composition of the mixture used to form the substrate; the sintering equipment used; and controlling the sintering conditions. For example, the composition of the mixture used to form the substrate may be adjusted by adding free tungsten to stoichiometric tungsten carbide (WC) and cobalt or by using a non-stoichiometric tungsten carbide material and cobalt to lower the magnetic saturation value, or by using carbon containing gases during sintering to react with free tungsten in solution to form tungsten carbide which increases the magnetic saturation value. As discussed above, various state of the art sintering equipment may be used. The desired magnetic saturation values may also be obtained by controlling the conditions during sintering such as time, temperature, pressure, carbon and oxygen content in the sintering environment, etc. Substrates of the present disclosure may be made by any state of the art process for sintering tungsten carbides capable of producing substrates with the desired magnetic saturation values, for example the process of Ceratizit Austria Gesellschaft m.b.H of Reutte, Austria.

In one or more embodiments, the magnetic saturation value within the substrate may be substantially uniform. By substantially uniform, it is meant that the magnetic saturation value of the binder phase does not vary by more than 5%, suitably by not more than 3%, within the substrate.

Figure 8:
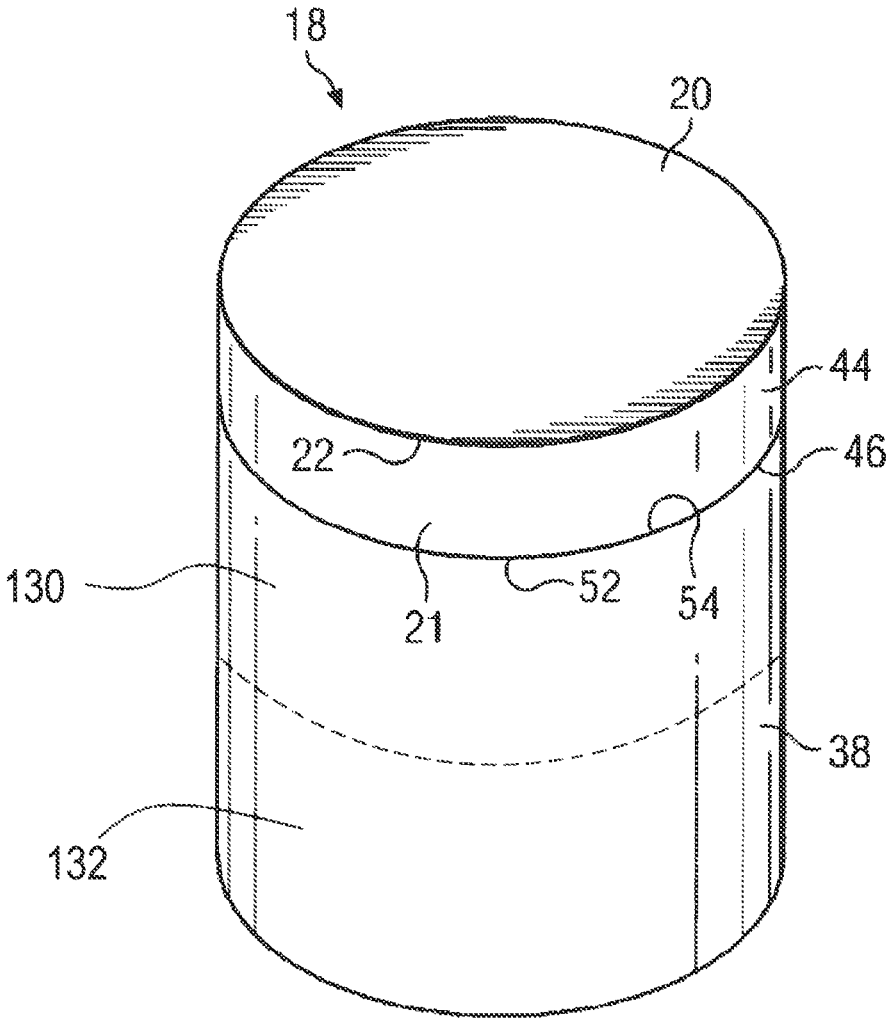
FIG. 8 is a perspective view of a shear cutting element.

In one or more embodiments, there may be a gradient in the magnetic saturation value within the substrate 38. The gradient may be a continuous uniform gradient extending from the interface 46 of the substrate 38 and the cutting layer 44 wherein the magnetic saturation value increases along the gradient. For example, the substrate 38 may have a gradient in magnetic saturation with a value in the range of from 80% to less than 85% proximal to the interface 46 and a value in the range of 95% to 100% distal from the interface 46. Alternatively, the gradient may be formed from one or more regions having different magnetic saturation values. For example, the substrate 38 may have a first region 130 proximal to the interface 46 with the cutting layer 44 having a magnetic saturation value in the range of from 80% to less than 85%, a second region 132 having a magnetic saturation value of less than 80% or at least 85% proximal to the first region 130, and optionally one or more additional regions with increasing or decreasing magnetic saturation values, as illustrated in FIG. 8. As discussed above, there are various methods for adjusting magnetic saturation values. Such methods may also be used to create a gradient in magnetic saturation values (i.e., a gradient in dissolved tungsten) within the substrate. Magnetic saturation values may be determined within the substrate by determining the content of tungsten in the binder phase since the composition of the binder phase (i.e., the amount of dissolved tungsten in the binder phase) is directly related to the magnetic saturation value. Calibrated electron dispersive spectroscopy (EDS) or x-ray fluorescence (XRF) can be used to determine the composition of the binder phase and thus the magnetic saturation values within a substrate.

In one or more embodiments, the substrate of the cutting element has a narrow tungsten carbide grain size distribution. The "narrowness" or span of the grain size distribution may be characterized by the following equation:

$$GSDC=(d_{95}-d_5)/d_{50}$$

The term "grain size", as used herein, is the size of the tungsten carbide grains in the carbide phase of the substrate as measured using electron backscattered diffraction. The term "$d_{50}$", as used herein, represents a grain size at which there are an equal volume of grain sizes smaller and larger than the stated median grain size. The term, "$d_{95}$", as used herein, represents a grain size where ninety five percent by volume of the grain sizes are smaller than the stated value for $d_{95}$. The term "$d_5$", as used herein, represents a grain size where five percent by volume of the grain sizes are smaller than the stated value for $d_5$. The value for the span of the grain size distribution curve may be in the range of from 1 to 2.5, suitably in the range of from 1.2 to 2. Without wishing to be bound by theory, it is believed that by controlling the magnetic saturation values within the range of from 80% to less than 85%, as discussed above, the tungsten carbide grain growth typically observed post-sintering can be reduced without the use of grain growth inhibitors. For example, the post-sintered substrate may suitably be substantially free of large tungsten carbide grains having a grain size of greater than 6 times the median grain size of the pre-sintered tungsten carbide, more suitably substantially free of tungsten carbide grains greater than 4 times the median grain size of the pre-sintered tungsten carbide. For the purposes of this patent specification and appended claims, the term "substantially free" means that the substrate comprises less than 5% by volume, suitably less than 2% by volume, more suitably less than 1% by volume, most suitably less than 0.5% by volume of large tungsten carbide grains, as discussed above, in particular the substrate suitably comprises no large tungsten carbide grains. Without wishing to be bound by theory, it is believed that reducing tungsten carbide grain growth during sintering without the use of grain growth inhibitors can improve the erosion resistance of the cutting element substrate. Erosion resistance is a form of wear resistance. It is desirable to prevent erosion of the cutting element substrate so that the cutting elements may have a longer useful life and may even be reused in a subsequent drill bit.

FIG. 7 is a table of data for three different groups of tungsten carbide substrates, Group A, B and C, respectively, and of cutting elements formed from such substrates using PCD as the ultra hard material in the cutting layer. The PCD grade, interface geometry, cutting layer working surface geometry, and sintering conditions were kept constant for each PCD cutting layer formed over each of the substrates. The cutting elements were shear cutters.

Twenty four substrates in each of Groups A, B and C were tested for flexural strength. The method for measuring flexural strength of the substrates was performed in accordance with ASTM C1161 with adjustments made to accommodate smaller test samples (1 mm×2 mm×8.4 mm).

Four cutting elements in each of Groups A, B and C were tested for impact resistance. The method for measuring impact resistance of the cutting elements was performed by placing the cutting element in a fixture at a 20° back rake angle and impacting the cutting element at energy levels of 10 J and 20 J against A2 tool steel hardened to between 61-63 $R_C$. The cutting elements were inspected after each impact for fracture damage. If the cutting element did not fail inspection, the cutting element was subjected to an additional impact load. This was repeated until failure or a maximum of five impacts had been performed. The impacts were performed with commercial impact resistance test equipment manufactured by Instron Corporation Model: Dynatupe 9250HV.

Eight cutting elements in each of Groups A, B and C were tested for MGL wear resistance. The method for measuring the MGL wear resistance involved machining the surface of a rotating cylinder of Barre granite. The log was machined at 400 surface feet per minute (122 surface meters/min) using a 0.630 inch (16 mm) diameter cutting element. There was an average depth of cut of 0.020 inches (0.51 mm) and a feed rate of 0.010 inch/rev (0.26 mm/rev). The cutting tool had a back rake angle of 15°. To assess the cutter, a wear ratio of the volume of log removed relative to the volume of cutting tool removed was determined.

For the flexural strength and MGL wear resistance data, the t-test shows a confidence level greater than 95%; therefore, the differences between Group A and Groups B and C were statistically significant.

Four cutting elements in each of Groups A, B and C were tested for milling impact wear resistance. The method for measuring milling impact involved mounting a 0.630 inch (16 mm) diameter cutting element to a fly cutter for machining a face of a block of Barre granite. The fly cutter rotated about an axis perpendicular to the face of the granite block and traveled along the length of the block so as to make a scarfing cut in one portion of the revolution of the fly cutter. In particular, the fly cutter was rotated at 3400 rpm. The travel of the fly cutter along the length of the scarfing cut was at a rate of 5 inches per minute (12.7 centimeters/min). The depth of the cut, i.e., the depth perpendicular to the direction of travel, is 0.10 inch (2.5 mm). The cutting path, i.e., offset of the cutting disk from the axis of the fly cutter is 0.75 inch (19.1 mm). The cutting element has a back rake angle of 10°. A determination was made of how many inches (millimeters) of the granite block was cut prior to failure of the cutting element.

The data in FIG. 7 demonstrates that cutting elements of the present disclosure unexpectedly provide an improvement in substrate flexural strength and cutting element wear resistance while still maintaining impact resistance and thermal stability.

In certain embodiments of the present disclosure, cutting elements may be manufactured by selecting a first batch of sintered tungsten carbide substrates having magnetic saturation values that vary by at most 5%, suitably by at most 4%, more suitably by at most 2.5%. A second batch of substrates is selected having magnetic saturation values that vary by at most 5%, suitably by at most 4%, more suitably by at most 2.5%. The magnetic saturation values of the first batch of substrates and the second batch of substrates vary by at most 5%, suitably by at most 4%, more suitably by at most 2.5%. A cutting layer is formed on a surface of the first and second batches of substrates, such methods for forming a cutting layer on a substrate are discussed hereinbefore. This embodiment is of particular significance for substrates manufactured using standard large-scale commercial vacuum furnaces to sinter the substrates.

In practice, the magnetic saturation of substrates used for cutting elements varies widely, for example ranges of 15-20% are typical in the industry. In one or more embodiments, it is advantageous to be able to specify a specific narrow range of magnetic saturation values for a batch of substrates within a possible range of from 80% to 100% magnetic saturation and to reduce the variability from batch-to-batch. For example, a batch of substrates may have a range of magnetic saturation values from 80% to less than 85%, or from 81% to 84%, or from 80% to 83%, or from 82% to 84%, or from 85% to 90%, or from 85% to 87%, or from 86% to 89%, or any other additional narrow ranges within the 80% to 100% magnetic saturation range. The magnetic saturation values of a batch of substrates may have an average value in the range of from 82% to 84%, or from 85% to 87%, or from 88% to 90%. Properties such as the melting point of the binder phase are dependent on magnetic saturation, which in turn affects the consistency of the cutting element processing. Selecting substrates such that the variation of the magnetic saturation values is controlled within a target range of magnetic saturation values within batches and batch-to-batch can lead to more tightly controlled melting points within the binder phase of the substrate which reduces the instances of too rapid infiltration of the binder into the cutting layer resulting in reduced interface defects. Further, substrates with specific ranges of magnetic saturation values may be selected to provide one or more desired improved properties such as cutting element wear resistance and substrate flexural strength.

As an illustration, a first batch of substrates may be selected having a range of magnetic saturation values from 86% to 88.5% (i.e., a magnetic saturation variation of at most 2.5% in the first batch); a second batch of substrates may be selected having a range of magnetic saturation values from 85% to 87.5% (i.e., a magnetic saturation variation of at most 2.5% in the second batch and the first batch not differing from the second batch by at most 4%); and a cutting layer disposed on a surface of such substrates. The magnetic saturation values are as measured on the whole substrate.

Although illustrative embodiments of the present disclosure have been shown and described, a wide range of modifications, changes and substitution is contemplated in the foregoing disclosure. In some instances, some features of the present disclosure may be employed without a corresponding use of the other features. Accordingly, it is appropriate that the appended claims be construed broadly and in any manner consistent with the scope of the invention

What is claimed is:

1. A cutting element comprising:

a substrate comprising tungsten carbide and a metal binder which substrate has a magnetic saturation value in the range of from 80% to less than 85%; and a cutting layer disposed on a surface of the substrate which cutting layer comprises an ultra hard material said cutting element formed by high pressure high temperature (HPHT) sintering.

2. The cutting element of claim 1, wherein the substrate has a magnetic saturation value in the range of from 80.5% to 84.5%.

3. The cutting element of claim 1, wherein the substrate has a magnetic saturation value in the range of from 81% to 84%.

4. The cutting element of claim 1, wherein the substrate has a tungsten carbide grain size distribution such that the span of the grain size distribution curve has a value in the range of from 1 to 2.5, wherein the span of the grain size distribution curve is characterized by the following equation: GSDC= $(d_{95}-d_5)/d_{50}$ wherein $d_{95}$ is a grain size for which 95% by volume of the grain sizes are smaller, $d_{50}$ is a grain size for which 50% by volume of the grain sizes are smaller, and $d_5$ is a grain size for which 5% by volume of the grain sizes are smaller.

5. The cutting element of claim 1, wherein the cutting layer comprises thermally stable polycrystalline diamond.

6. The cutting element of claim 1, wherein the metal binder comprises cobalt.

7. The cutting element of claim 1, wherein in the ultra hard material comprises polycrystalline diamond.

8. The cutting element of claim 1, wherein the substrate is substantially free of tungsten carbide grains having a grain size of greater than 6 times the median grain size of the pre-sintered tungsten carbide.

9. The cutting element of claim 1, wherein the substrate has a magnetic saturation range from 80% to 83.4%.

10. The cutting element of claim 1, wherein the cutting layer comprises a catalyst material at an amount less than 5 wt % based on the total weight of the cutting layer.

11. The cutting element of claim 1, wherein a surface of the cutting layer opposite the substrate is leached.

12. The cutting element of claim 1 wherein the ultra hard particles have an average diameter grain size in the range of from 1 nm to 50 nm.

13. A cutting element comprising:

a substrate comprising a tungsten carbide and a metal binder; and a cutting layer disposed on a surface of the substrate which cutting layer comprises an ultra hard material;

wherein the magnetic saturation value increases within the substrate along a gradient in the direction away from the interface of the substrate and the cutting layer, and wherein within the substrate proximal to the interface, the magnetic saturation value is in the range of from 80% to less than 85%, said cutting element formed by high pressure high temperature (HPHT) sintering.

14. The cutting element of claim 13, wherein the magnetic saturation value varies such that there is a uniform gradient within the substrate.

15. The cutting element of claim 13, wherein the substrate has a first region proximal to the interface of the substrate and the cutting layer which first region has a magnetic saturation value in the range of from 80% to less than 85% and a second region proximal to the first region which second region has a magnetic saturation value of at least 85%.

16. The cutting element of claim 13, wherein the substrate has a magnetic saturation range from 80% to 83.4%.

17. A drill bit comprising:

a bit body; and a plurality of cutting elements formed by high pressure high temperature (HPHT) sintering affixed to said bit body, wherein at least one of said plurality of cutting elements comprises a substrate containing tungsten carbide and a metal binder which substrate has a magnetic saturation value in the range of from 80% to less than 85%, and a cutting layer disposed on a surface of the substrate which cutting layer comprises an ultra hard material.

18. The drill bit of claim 17, wherein the substrate has a magnetic saturation value in the range of from 80.5% to 84.5%.

19. The drill bit of claim 17, wherein the substrate has a magnetic saturation value in the range of from 81% to 84%.

20. The drill bit of claim 17, wherein the substrate has a tungsten carbide grain size distribution such that the span of the grain size distribution curve has a value in the range of from 1 to 2.5, wherein the span of the grain size distribution curve is characterized by the following equation: GSDC= $(d_{95}-d_5)/d_{50}$ wherein $d_{95}$ is a grain size for which 95% by volume of the grain sizes are smaller, $d_{50}$ is a grain size for which 50% by volume of the grain sizes are smaller, and $d_5$ is a grain size for which 5% by volume of the grain sizes are smaller.

21. The drill bit of claim 17, wherein the cutting layer comprises thermally stable polycrystalline diamond.

22. The drill bit of claim 17, wherein the metal binder comprises cobalt.

23. The drill bit of claim 17, wherein in the ultra hard material comprises polycrystalline diamond.

24. The drill bit of claim 17, wherein the substrate is substantially free of tungsten carbide grains having a grain size of greater than 6 times the median grain size of the pre-sintered tungsten carbide.

25. The drill bit of claim 17, wherein the substrate has a magnetic saturation range from 80% to 83.4%.

26. A cutting element, comprising:

a substrate comprising tungsten carbide and a metal binder which substrate has a magnetic saturation value in the range of from 80% to less than 85% and a tungsten carbide grain size distribution such that the span of the grain size distribution curve has a value in the range of from 1 to 2.5, wherein the span of the grain size distribution curve is characterized by the following equation: $GSDC=(d_{95}-d_5)/d_{50}$ and wherein $d_{95}$ is a grain size for which 95% by volume of the grain sizes are smaller, $d_{50}$ is a grain size for which 50% by volume of the grain sizes are smaller, and $d_5$ is a grain size for which 5% by volume of the grain sizes are smaller; and a cutting layer disposed on a surface of the substrate which cutting layer comprises an ultra hard material, the cutting element formed by high pressure high temperature (HPHT) sintering.

27. The cutting element of claim 26, wherein the substrate has a magnetic saturation range from 80% to 83.4%.

* * * * *